US007686706B2

(12) United States Patent
Matsunaga et al.

(10) Patent No.: US 7,686,706 B2
(45) Date of Patent: Mar. 30, 2010

(54) GOLF CLUB HEAD

(75) Inventors: Hideo Matsunaga, Chichibu (JP); Makoto Kubota, Tokyo (JP); Masaomi Hiruta, Tokyo (JP)

(73) Assignee: Bridgestone Sports Co., Ltd., Shinagawa-ku, Tokyo (JP)

( * ) Notice: Subject to any disclaimer, the term of this patent is extended or adjusted under 35 U.S.C. 154(b) by 51 days.

(21) Appl. No.: 12/106,490

(22) Filed: Apr. 21, 2008

(65) Prior Publication Data

US 2008/0261720 A1 Oct. 23, 2008

(30) Foreign Application Priority Data

Apr. 20, 2007 (JP) ..... 2007-111542

(51) Int. Cl.
*A63B 53/04* (2006.01)

(52) U.S. Cl. ..... 473/329; 473/342; 473/346

(58) Field of Classification Search ..... 473/324–350
See application file for complete search history.

(56) References Cited

U.S. PATENT DOCUMENTS 4,214,754 A * 7/1980 Zebelean ..... 473/346
4,429,879 A * 2/1984 Schmidt ..... 473/346
4,984,800 A * 1/1991 Hamada ..... 473/346
5,261,664 A * 11/1993 Anderson ..... 473/342
5,294,037 A * 3/1994 Schmidt ..... 228/125
5,303,922 A * 4/1994 Lo ..... 473/330
5,704,850 A * 1/1998 Shieh ..... 473/324
5,709,615 A * 1/1998 Liang ..... 473/324
6,299,549 B1 * 10/2001 Shieh ..... 473/342
6,481,088 B1 * 11/2002 Inoue et al. ..... 29/527.5
6,645,086 B1 11/2003 Chen
6,663,501 B2 12/2003 Chen
6,669,576 B1 12/2003 Rice
6,719,645 B2 * 4/2004 Kouno ..... 473/345
6,780,124 B2 * 8/2004 Lu ..... 473/342
6,783,466 B2 * 8/2004 Seki et al. ..... 473/345
6,821,214 B2 11/2004 Rice
6,832,961 B2 * 12/2004 Sano ..... 473/324
6,875,126 B2 * 4/2005 Yabu ..... 473/305
7,056,228 B2 * 6/2006 Beach et al. ..... 473/345
7,096,558 B2 * 8/2006 Sano ..... 29/428
7,121,958 B2 * 10/2006 Cheng et al. ..... 473/345

(Continued)

FOREIGN PATENT DOCUMENTS

JP 6-343722 A 12/1994

(Continued)

*Primary Examiner*—Sebastiano Passaniti
(74) *Attorney, Agent, or Firm*—Sughrue Mion, PLLC

(57) ABSTRACT

This invention provides a golf club head including a head main body, a face plate and a hollow portion. The head main body includes an opening in a face portion, and the opening is provided with a plurality of pawls to receive the face plate which is to fit in the opening. The pawls include a large pawl and a small pawl. The large pawl is arranged in each of a heel-side upper portion and a toe-side lower portion and the small pawl is arranged in at least either one of a heel-side lower portion and a toe-side upper portion when the opening is divided into four vertically and horizontally about a face center as the center. The face plate is fitted in the opening and fixed by welding.

9 Claims, 6 Drawing Sheets

U.S. PATENT DOCUMENTS

| | | | | |
|---|---|---|---|---|
| 7,160,204 | B2 * | 1/2007 | Huang | 473/342 |
| 7,207,898 | B2 | 4/2007 | Rice et al. | |
| 7,396,291 | B2 * | 7/2008 | Lo | 473/324 |
| 7,396,297 | B2 * | 7/2008 | Hirano | 473/345 |
| 7,413,517 | B2 * | 8/2008 | Butler et al. | 473/288 |
| 7,479,070 | B2 * | 1/2009 | Hirano | 473/345 |
| 7,559,853 | B2 * | 7/2009 | Hirano | 473/324 |
| 2002/0065147 | A1 | 5/2002 | Sano | |
| 2003/0104878 | A1 | 6/2003 | Yabu | |

FOREIGN PATENT DOCUMENTS

| | | | |
|---|---|---|---|
| JP | 2000-317018 | A | 11/2000 |
| JP | 2001-46559 | A | 2/2001 |
| JP | 2001-137396 | A | 5/2001 |
| JP | 2001-187174 | A | 7/2001 |
| JP | 2001-259091 | A | 9/2001 |
| JP | 2002-113134 | A | 4/2002 |
| JP | 2003-159354 | A | 6/2003 |
| JP | 2003-290399 | A | 10/2003 |

* cited by examiner

GOLF CLUB HEAD

BACKGROUND OF THE INVENTION

1. Field of the Invention

The present invention relates to a golf club head and, more particularly, to a metal golf club head incorporating a hollow portion.

2. Description of the Related Art

Conventionally, when manufacturing the head main body of a metal hollow golf club head by casting, it is generally done by investment casting (lost wax process). When manufacturing the head main body in accordance with this process, an opening must be formed in the head main body so that the core of the mold to form a hollow portion can be extracted through it. Therefore, an opening is formed in the sole portion or face portion. A face plate formed by forging or press molding is fitted in the opening formed, for example, in the face, and fixed by welding, thus forming a golf club head.

When forming an opening in a head main body and fitting a fitted member such as a face plate in the opening, a stopper is provided inside the opening so that the fitted member will not drop into the hollow portion. This facilitates welding of the fitted member to the head main body. As the stopper, a pawl projecting from part of the opening (for example, see Japanese Patent Laid-Open Nos. 2001-259091 and 2001-46559), or a ridge projecting along the edge of the opening may be used.

When forming a pawl or ridge serving as the stopper inside the opening formed in the face portion, as in the conventional case, the pawl or ridge interferes with the face plate's ability to flex and decreases the rebound of the ball. This decreases the traveling distance of the ball.

Particularly, the conventional design as described above is developed under the assumption that the golfer hits the ball with the sweet spot of the golf club head. If the golfer is a general amateur golfer whose hitting point varies largely, it is difficult for him to hit the ball on the sweet spot. When the golfer hits the ball at a hitting point off the sweet spot, the rebound of the ball decreases, and the traveling distance of the ball decreases greatly. Also, the traveling distance greatly changes depending on the hitting point.

Variations in hitting point of general amateur golfers are studied. The hitting points vary within an ellipse as indicated by an area Z in FIG. 5, which has as a major axis a line D that connects the toe-side upper portion to the heel-side lower portion.

SUMMARY OF THE INVENTION

It is an object of the present invention to provide a metal hollow golf club head with which even if the hitting point varies as is with a general amateur golfer and the golfer hits the ball off the center (off the sweet spot), a decrease in traveling distance is small, and the traveling distance does not change greatly depending on the position of the hitting point.

According to a aspect of the present invention, there is provided a golf club head comprising a head main body, a face plate and a hollow portion, wherein the head main body includes an opening in a face portion, the opening is provided with a plurality of pawls to receive the face plate which is to fit in the opening, the pawls include a large pawl and a small pawl, the large pawl being arranged in each of a heel-side upper portion and a toe-side lower portion and the small pawl being arranged in at least either one of a heel-side lower portion and a toe-side upper portion when the opening is divided into four vertically and horizontally about a face center as the center, and the face plate is fitted in the opening and fixed by welding.

With this golf club, even if the hitting point varies and the golfer hits the ball off-center (off the sweet spot), a decrease in traveling distance is small, and a change in traveling distance depending on the position of the hitting point can be decreased.

In such a golf club head, the pawls are not preferably arranged on a toe side and crown portion side, and/or on a heel side and sole portion side. This sufficiently ensures that face plate may flex on the toe side and crown portion side, and/or the heel side and sole portion side. Even if the hitting point is on the toe side and crown portion side and/or the heel side and sole portion side, a decrease in traveling distance is small, so that a change in traveling distance depending on the position of the hitting point can be decreased.

When a pawl is provided on the toe side and crown portion side and/or the heel side and sole portion side, it must be smaller than that at any other position and extend short toward the face.

According to another aspect of the present invention, there is provided a golf club head comprising a head main body, a face plate and a hollow portion, wherein the head main body includes an opening in a face portion, the opening is provided with a plurality of pawls to receive the face plate which is to fit in the opening, the pawls are arranged on a heel-side upper portion (i.e., hosel side) and a toe-side lower portion and not on a heel-side lower portion and a toe-side upper portion when the opening is divided into four vertically and horizontally about a face center as the center, and the face plate is fitted in the opening and fixed by welding.

With this golf club head, the face plate is sufficiently ensured to be allowed to flex on the heel-side lower portion and the toe-side upper portion. Even if the hitting point varies in the heel-side lower portion and the toe-side upper portion, a decrease in traveling distance is small, so that a change in traveling distance depending on the position of the hitting point can be decreased.

In such a golf club head, preferably, the opening includes a notch on the toe-side upper portion on a crown portion side and/or the heel-side lower portion on a sole portion side, the face plate forms an extending portion at an upper end and/or lower end thereof to fit with the notch, and the face plate is fitted in the opening by abutting an end face of the extending portion against a thickness of the crown portion and/or a thickness of the sole portion. Then, the extending portion can compensate for the disadvantage in that the face is short in the direction of height when compared to in the direction of length (toe-and-heel direction) and cannot flex easily. Namely, that portion of the face place where the extending portion is provided can be allowed to flex more easily. Even if the hitting point varies in the heel-side lower portion and the toe-side upper portion, a decrease in traveling distance is small, so that a change in traveling distance depending on the position of the hitting point can be decreased.

Furthermore, in the golf club head as described above, the face plate is preferably made of a metal having a Young's modulus lower than that of the head main body. This improves the rebound of the ball, thus increasing the traveling distance.

According to still another aspect of the present invention, there is provided a golf club comprising a golf club head as described above.

Further features of the present invention will become apparent from the following description of exemplary embodiments (with reference to the attached drawings).

DESCRIPTION OF THE EMBODIMENTS

Figure 1:
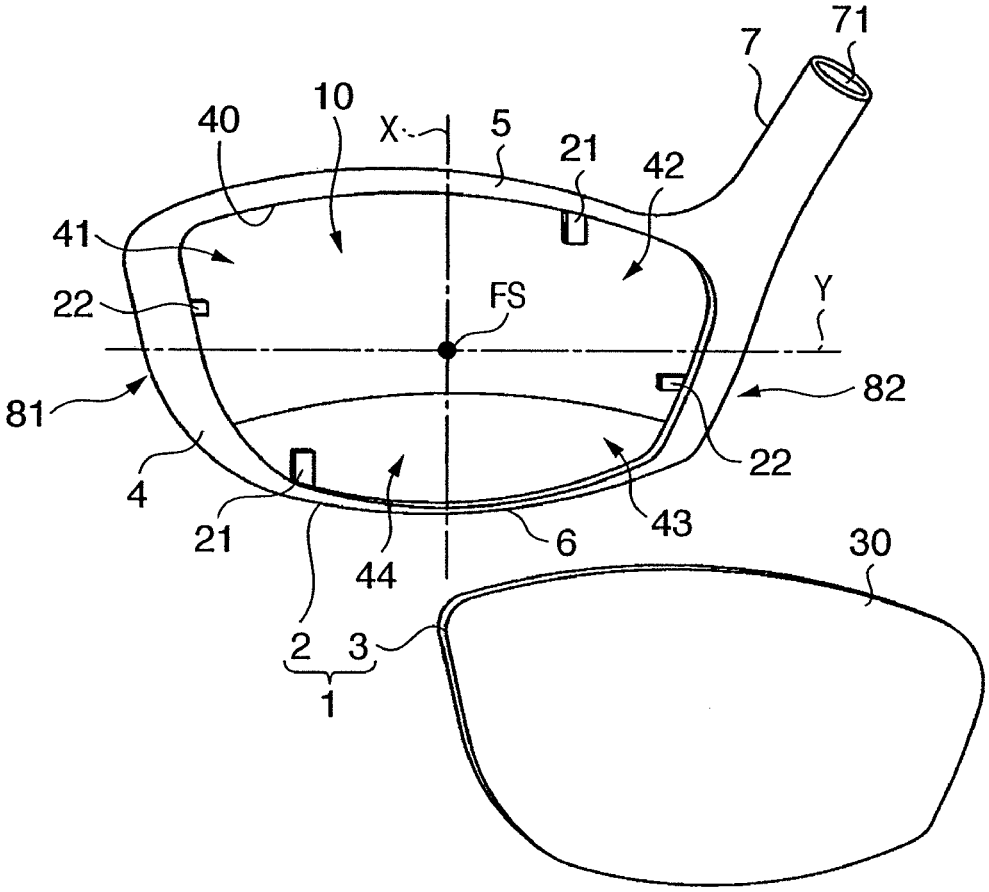
FIG. 1 is an exploded perspective view of a golf club head according the first embodiment of the present invention.

Preferred embodiments of the present invention will now be described in detail in accordance with the accompanying drawings.

A golf club head 1 comprises a head main body 2 including a hollow portion 10 and having an opening 40 in a face portion 4, and a face plate 3 fitted in and fixed to the opening 40. A shaft (not shown) is mounted in a hole 71 of a hosel 7 provided to the head main body 2, thus forming a golf club.

Preferably, the golf club head 1 is applied to a golf club head for a particularly large-size driver. A large-size head refers to a head with a head volume of 350 cc or more. The head of the present invention preferably has a volume of 360 cc to 500 cc.

The metal as the material of the head main body 2 is not particularly limited, and stainless steel, marageing steel, beryllium steel, a titanium alloy, an aluminum alloy, a magnesium alloy, or the like can be employed. Particularly, the titanium alloy has a specific gravity of 4.2 to 5.0 which is low as a metal and a tensile strength which is large for its low Young's modulus. As the titanium alloy can accordingly form a thin golf club head, it can be used to form a large head volume of 360 cc to 500 cc, which is preferable. The head main body 2 is integrally manufactured with the face portion 4, a crown portion 5, a sole portion 6, and the hosel 7 in accordance with the lost wax process. However, the head main body 2 is not limited to this but can be manufactured by forging or the like.

The metal as the material of the face plate 3 is not particularly limited, and a metal material having a lower Young's modulus than that of the head main body 2 is preferable, because it improves the rebound of the ball. For example, when the head main body 2 is formed using a general Ti-6Al-4V titanium alloy (Young's modulus: about 110 Gpa), the face plate 3 may be formed using a titanium metal, for example, Ti-15Mo-3Al, having a Young's modulus of less than 100 Gpa. The face plate 3 is formed by forging, press molding, or the like, but is not limited to them. The face plate 3 is fitted in the opening 40 and fixed to it by welding.

The opening 40 forms an almost rectangular shape which is long in the direction of a toe 81 and heel 82, or an almost inverted-trapezoidal shape which is long in the direction of the toe 81 and heel 82 and longer on the crown portion 5 side than the sole portion 6 side. Accordingly, the face plate 3 also forms an almost rectangular shape or an almost inverted-trapezoidal shape.

The opening 40 is provided with a pawl serving as a stopper to receive the face plate 3 which is to fit in the opening 40. As the pawl, a large pawl 21 and small pawl 22 are provided. Each of the pawls 21 and 22 is formed by fixing a plate body to the inner wall surface of the head main body 2 at its one end by welding or the like and projecting the other end into the opening 40. Each of large and small sizes signifies the relative size of the pawl, and the large pawl 21 is larger than the small pawl 22. The large pawl 21 has a size projecting from the edge of the opening 40 by 3 mm to 5 mm. The small pawl 22 has a size projecting from the edge of the opening 40 by 0 mm or more (the lower limit is not limited) to 2.5 mm, and preferably 0.5 mm to 2 mm. Alternatively, all the pawls can have the same size projecting from the edge of the opening 40 by 1 mm to 3 mm. The width of the pawl is not particularly limited as far as the pawl can stably receive the face plate 3, and even suffices with 1 mm to 2 mm. The shape of the pawl is not limited to the rectangle shown in FIG. 1 but can change.

According to the first embodiment shown in FIG. 1, regarding arrangement of the pawls 21 and 22 in areas 41 to 44 formed by dividing the opening 40 into four vertically and horizontally about a face center FS as the center with lines X and Y extending through the face center FS on the crown portion 5 side and sole portion 6 side, and the toe 81 side and heel 82 side, the large pawls 21 are respectively arranged in the heel-side upper portion 42 and toe-side lower portion 44, and the small pawls 22 are respectively arranged in the heel-side lower portion 43 and toe-side upper portion 41.

Alternatively, the small pawl 22 may be arranged only in one area of the heel-side lower portion 43 and toe-side upper portion 41. Neither small pawls 22 nor large pawls 21 need be arranged in any of the heel-side lower portion 43 and toe-side upper portion 41. This arrangement sufficiently ensures the face plate may flex on the heel-side lower portion and toe-side upper portion. Even if the hitting point varies in the heel-side lower portion and toe-side upper portion, a decrease in traveling distance is small, so that a change in traveling distance depending on the position of the hitting point can be decreased. Two or more large pawls 21, or two or more large pawls 21 as well as two or more small pawls 22 may be arranged in each of the heel-side upper portion 42 and toe-side lower portion 44.

If neither small pawls 22 nor large pawls 21 are to be arranged in either one of the heel-side lower portion 43 and toe-side upper portion 41, the pawls to be arranged in the heel-side upper portion 42 and toe-side lower portion 44 can be small pawls 22.

The pawls 21 and 22 can be arranged on, in each of the areas 41 to 44, any of the toe 81 side, crown portion 5 side, and sole portion 6 side, or any of the heel 82 side, crown portion 5 side, and sole portion 6 side. To arrange the pawls 21 and 22 on the toe 81 side or heel 82 side is preferable particularly in the heel-side lower portion 43 or toe-side upper portion 41. This is due to the following reason. The width of the face plate 3 is larger in the lateral direction from the toe 81 to the heel 82 than in the direction of height from the crown portion 5 to the sole portion 6. Even if the pawls 21 and 22 are arranged on the side portion of the face plate 3, that is, on the toe 81 side or heel 82 side, they do not largely adversely affect flexure of the face plate 3.

Accordingly, the small pawl 22 may or need not be set in the toe-side upper portion 41 or heel-side lower portion 43 depending on the case. Even when setting the small pawl 22, preferably, it is not set on the toe 81 side and crown portion 5 side, in other words, in the toe-side upper portion 41 on the crown portion 5 side. This arrangement sufficiently ensures the face plate may flex on the toe side and crown portion side. Even if the hitting point is on the toe side and crown portion side, a decrease in traveling distance is small, so that a change in traveling distance depending on the position of the hitting point can be decreased.

Furthermore, preferably, the small pawl 22 is not arranged on the heel 82 side and sole portion 6 side, in other words, in the heel-side lower portion 43 on the sole portion 6 side. This arrangement sufficiently ensures the face plate may flex on the heel side and sole portion side. Even if the hitting point is on the heel side and sole portion side, a decrease in traveling distance is small, so that a change in traveling distance depending on the position of the hitting point can be decreased.

Figure 5:
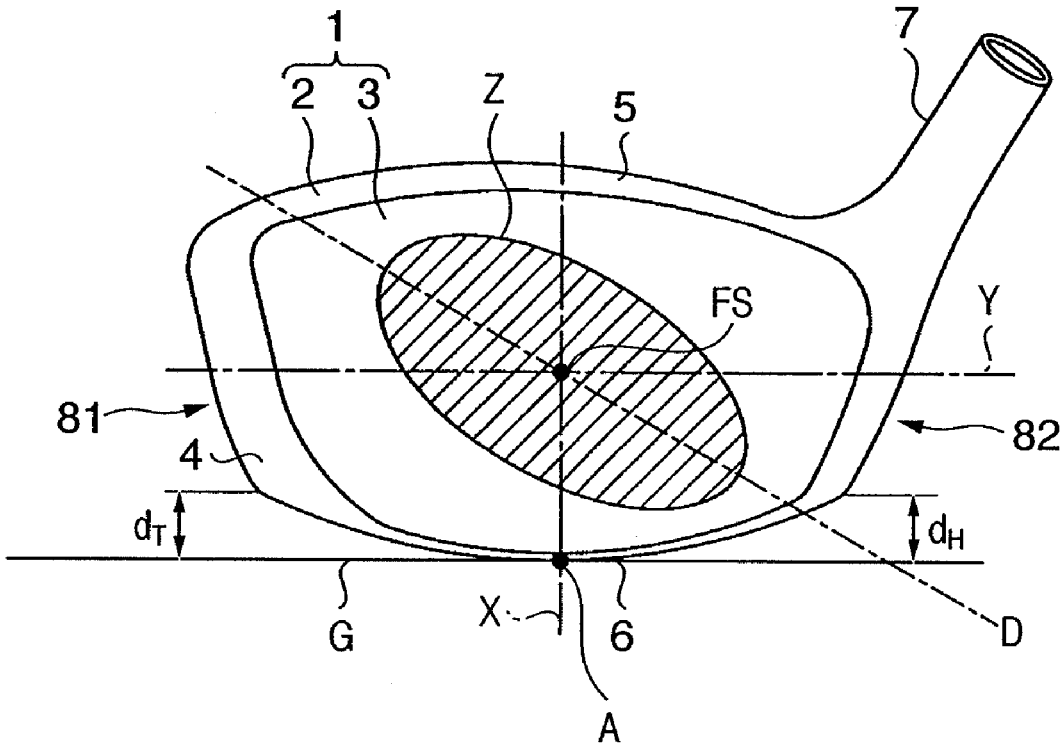
FIG. 5 is a front view of the golf club head of the first embodiment.
Figure 6:
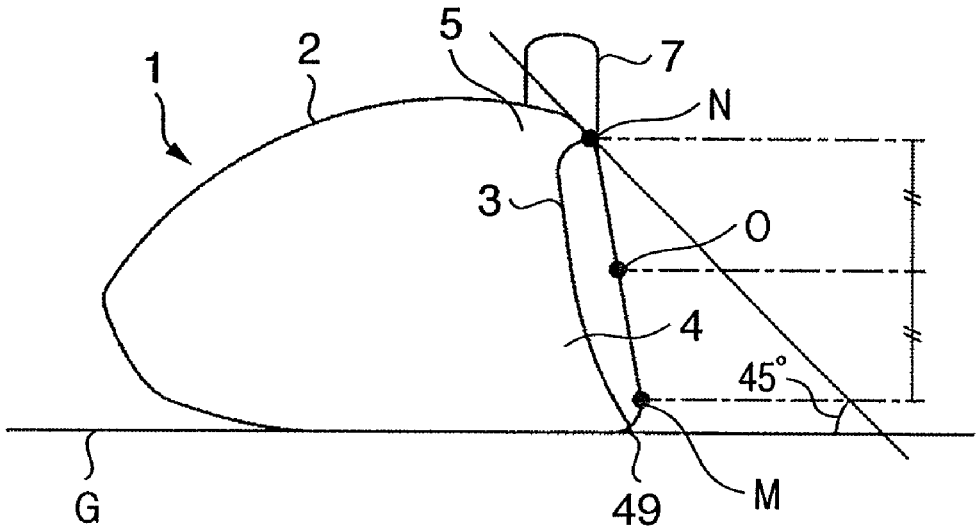
FIG. 6 is a side view of the golf club head of the first embodiment.

Assume that the golf club is set in a normal measurement state (if unknown, with a lying angle of 56°) and that the height of the gap between a horizontal plane G and the sole end is set to $d_T$ and $d_H$, which are equal, on the toe 81 side and a heel 82 side. Regarding the direction of the toe 81 and heel 82, that is, in the horizontal direction, as shown in FIG. 5, the areas 41 to 44 are divided into the left and right sides with reference to the line X extending vertically from a contact point A of the golf club with reference to the horizontal plane G, where the sole portion 6 is set, to the horizontal plane G. Furthermore, assume an intersection point M of the face portion 4 and a chamfered portion 49, and a point N which is the intersection point of the face portion 4 and crown portion 5 and is in contact with the horizontal plane G at an angle of 45°. Regarding the direction of the crown portion 5 and sole portion 6, that is, in the vertical direction, as shown in FIG. 6, the areas 41 to 44 are divided into the upper and lower sides with reference to the line Y extending through the middle point of to be parallel to the horizontal plane G.

More specifically, the face center FS is the intersection point of the lines X and Y. The areas 41 to 44 are defined with reference to the face center FS to be halved horizontally on the toe 81 side and heel 82 side, and halved vertically on the crown portion 5 side and sole portion 6 side.

Figure 2:
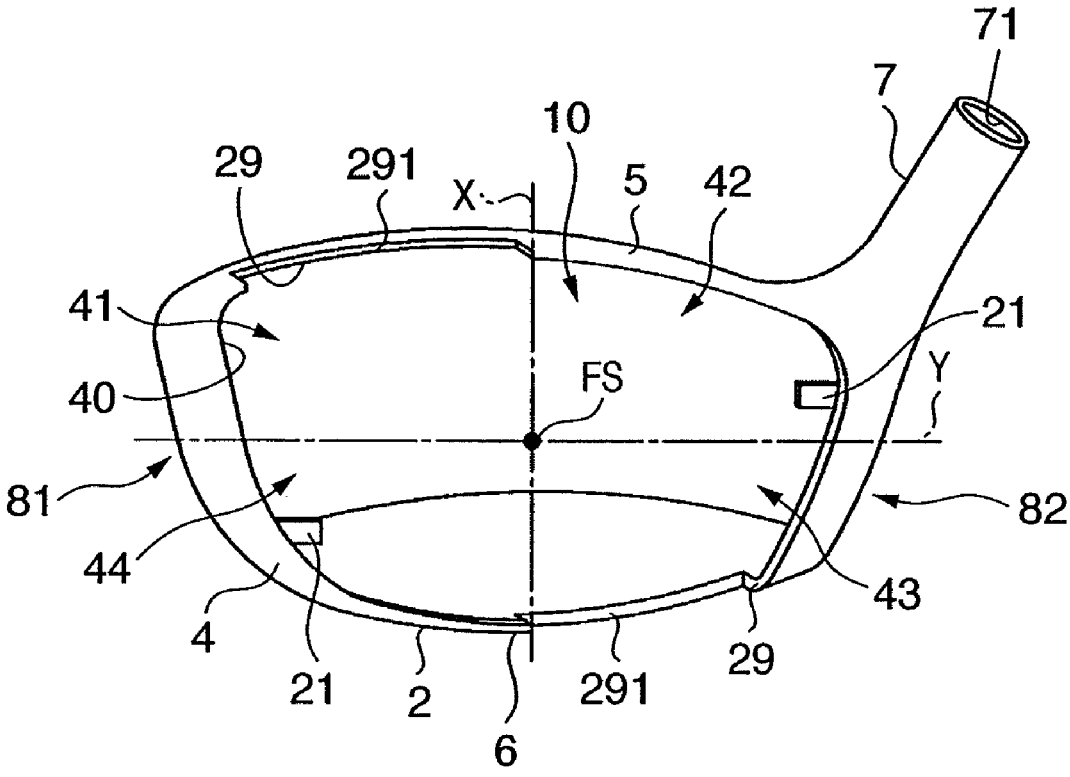
FIG. 2 is a perspective view of the head main body of a golf club head according to the second embodiment.
Figure 3:
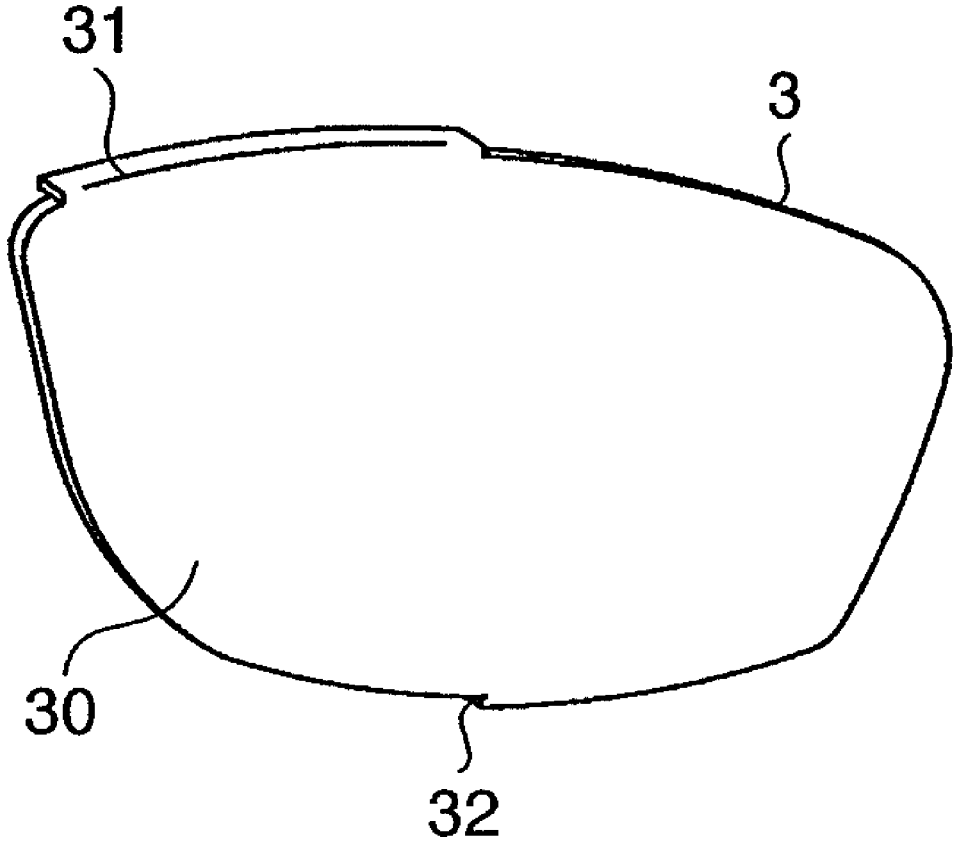
FIG. 3 is a perspective view of the face plate of the golf club head of the second embodiment.
Figure 4:
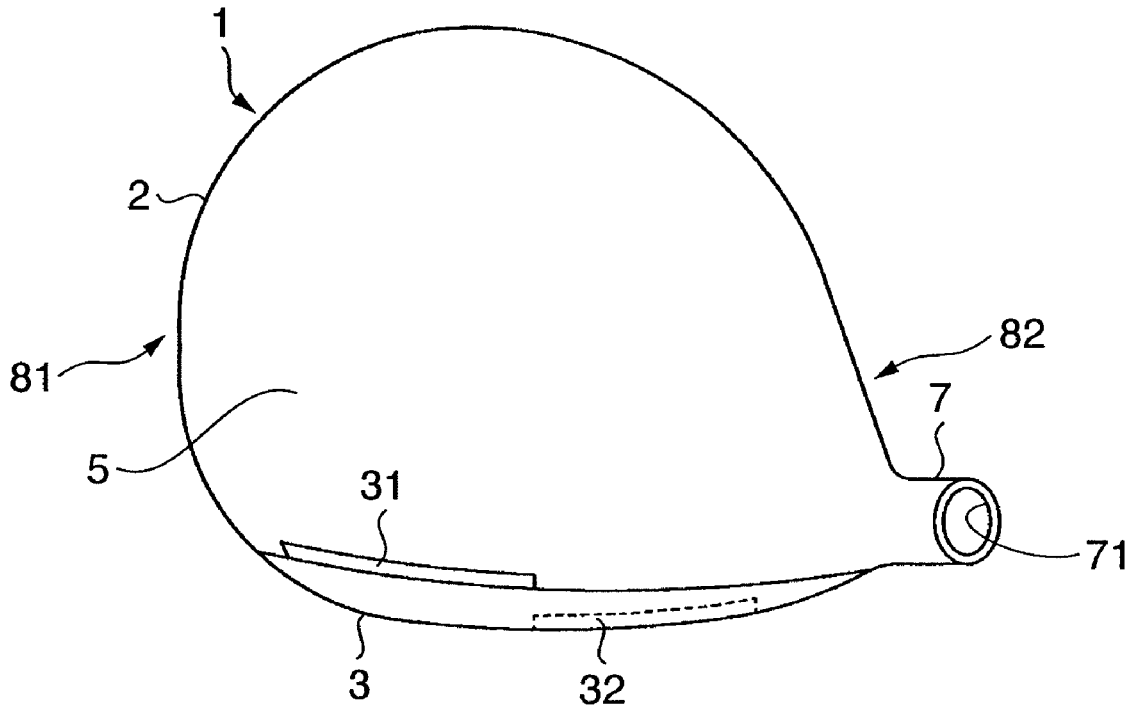
FIG. 4 is a plan view of the golf club head of the second embodiment.

In the second embodiment shown in FIGS. 2 to 4, notches 291 respectively formed in a toe-side upper portion 41 on a crown portion 5 side and in a heel-side lower portion 43 on a sole portion 6 side form an opening 40 to extend to part of the crown portion 5 of the toe-side upper portion 41 and part of the sole portion 6 of the heel-side lower portion 43. Extending portions 31 and 32 to fit with the respective notches 291 are formed on the upper end and lower end, respectively, of a face plate 3, as shown well in FIG. 3, to correspond to the shape of the opening 40. The face plate 3 is fitted in the opening 40 such that the end face of the extending portion 31 is abutted against the thickness of the crown portion 5 and the end face of the extending portion 32 is abutted against the thickness of the sole portion 6. Then, the face plate 3 is fixed by welding. This arrangement allows the face plate 3 to flex easily at portions where the extending portions 31 and 32 are provided. Even if the hitting points vary in the heel-side lower portion and toe-side upper portion, a decrease in traveling distance is small, so that a change in traveling distance depending on the position of the hitting point can be decreased.

Alternatively, the notch 291 may be formed in any one of the toe-side upper portion 41 on the crown portion 5 side and the heel-side lower portion 43 on the sole portion 6 side, and one of extending portions 31 and 32 corresponding to the notch 291 may be formed in the face plate 3.

The widths of the extending portions 31 and 32 are not particularly limited, but are preferably 5 mm to 40 mm, and more preferably 10 mm to 30 mm.

Regarding pawls to form in the opening 40, large pawls 21 are formed in a heel-side upper portion 42 and toe-side lower portion 44, and neither the large pawl 21 nor the small pawl 22 is formed in each of the toe-side upper portion 41 and heel-side lower portion 43 each having the notch 291. The sizes of the pawls to be arranged in the heel-side upper portion 42 and toe-side lower portion 44 are not particularly limited, and a small pawl 22 may be arranged there.

EXAMPLE

As shown in Table 1, golf clubs according to the first to third examples of the present invention and a comparative example were manufactured by changing the positions of the pawls 21 and 22 and by forming or not forming the extending portions 31 and 32 on the face plate. The traveling distances of the respective golf clubs were measured. In the measurement, three golfers each hit the ball 15 times with the golf clubs of the examples 1 to 3 and of the comparative example. An average traveling distance and the standard deviation of the traveling distances were obtained for each of the examples and the comparative example. Table 2 shows the results. In Table 2, the unit of the distance is yards (yd).

TABLE 1

| | Example 1 | | Example 2 | Example 3 | | Comparative Example |
|---|---|---|---|---|---|---|
| | Pawl 21 | Pawl 22 | Pawl | Pawl 21 | Pawl 22 | Pawl |
| Length (Projecting Amount) | 4 mm | 2 mm | 3.5 mm | 5 mm | 2 mm | 3.5 mm |
| Width | 2 mm | 1 mm | 2 mm | 2 mm | 1 mm | 2 mm |
| Position of Pawl | Crown portion on hosel side | Toe side portion on crown side | Crown portion on hosel side, crown-side side and heel portion | Crown portion on hosel side | Toe side portion on crown side | Crown portion on toe side, crown portion on toe side |
| | Sole and Toe side | Heel side portion on sole side | Sole portion on toe side, sole-side toe portion | Sole and Toe side | Heel side portion on sole side | Sole portion on toe side, sole portion on heel side |
| Extending Portion | None | | None | Crown portion 12 mm Sole portion 10 mm | | None |

TABLE 2

| | Example 1 | | Example 2 | | Example 3 | | Comparative Example | |
|---|---|---|---|---|---|---|---|---|
| | Average Traveling Distance | Standard Deviation | Average Traveling Distance | Standard Deviation | Average Traveling Distance | Standard Deviation | Average Traveling Distance | Standard Deviation |
| Golfer A | 213.8 | 3.2 | 213.5 | 4.8 | 215.2 | 3.9 | 210.5 | 4.9 |
| Golfer B | 237.9 | 4 | 238.8 | 3.1 | 238.3 | 2.8 | 234.7 | 4.2 |
| Golfer C | 262.4 | 3.4 | 263.6 | 3.7 | 265.2 | 2.8 | 260 | 4.8 |
| Average of three golfers | 238.0 | | 238.6 | | 239.6 | | 235.1 | |

As is apparent from Table 2, with the golf clubs using the golf club heads of the examples of the present invention, the average traveling distance of any one of the three golfers is larger than the average traveling distance of the comparative example. Even if the hitting points vary, a decrease in traveling distance is smaller than in the comparative example. Also, the standard deviation of each example is smaller than that of the comparative example, showing that the traveling distance does not vary.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-111542, filed Apr. 20, 2007, which is hereby incorporated by reference herein in its entirety.

What is claimed is:

1. A golf club head comprising a head main body, a face plate including a striking face and a hollow portion, wherein said head main body includes an opening in a face portion, said opening is provided with a plurality of pawls to receive said face plate which is to fit in said opening, said pawls include a large pawl and a small pawl which contact to said face plate on a back side of said striking face, said large pawl being arranged in each of a heel-side upper portion and a toe-side lower portion and said small pawl being arranged in at least either one of a heel-side lower portion and a toe-side upper portion when said opening is divided into four vertically and horizontally about a face center as the center, and said face plate is fitted in said opening and fixed by welding.

2. The head according to claim 1, wherein said head main body includes a crown portion, a sole portion and a side portion, said small pawl is arranged in at least the toe-side upper portion, and said small pawl in the toe-side upper portion is arranged on said side portion.

3. The head according to claim 1, wherein said head main body includes a crown portion, a sole portion and a side portion, said small pawl is arranged in at least the heel-side lower portion, and said small pawl in the heel-side lower portion is arranged on said side portion.

4. The head according to claim 1, wherein said face plate is made of a metal having a Young's modulus lower than that of said head main body.

5. A golf club head comprising a head main body, a face plate including a striking face and a hollow portion, wherein said head main body includes an opening in a face portion, said opening is provided with a plurality of pawls to receive said face plate which is to fit in said opening, said pawls contact to said face plate on a back side of said striking face, said pawls are arranged on a heel-side upper portion and a toe-side lower portion and not on a heel-side lower portion and a toe-side upper portion when said opening is divided into four vertically and horizontally about a face center as the center, and said face plate is fitted in said opening and fixed by welding.

6. The head according to claim 5, wherein said opening includes a notch on said toe-side upper portion on a crown portion side and/or said heel-side lower portion on a sole portion side, said face plate forms an extending portion at an upper end and/or lower end thereof to fit with said notch, and said face plate is fitted in said opening by abutting an end face of said extending portion against a thickness of said crown portion and/or a thickness of said sole portion.

7. The head according to claim 5, wherein said face plate is made of a metal having a Young's modulus lower than that of said head main body.

8. A golf club comprising:

a shaft; and a golf club head according to claim 1 attached to said shaft.

9. A golf club comprising:

a shaft; and a golf club head according to claim 5 attached to said shaft.

* * * * *